US008668083B1

(12) United States Patent
Meil et al.

(10) Patent No.: US 8,668,083 B1
(45) Date of Patent: Mar. 11, 2014

(54) DUGOUT LOCKER

(76) Inventors: John Meil, Jarretsville, MD (US); LeeAnn Staples, Lafayette, CO (US); Herbert Riehl, Lafayette, CO (US)

( * ) Notice: Subject to any disclaimer, the term of this patent is extended or adjusted under 35 U.S.C. 154(b) by 108 days.

(21) Appl. No.: 13/134,795

(22) Filed: Jun. 17, 2011

Related U.S. Application Data

(60) Provisional application No. 61/397,913, filed on Jun. 17, 2010.

(51) Int. Cl.
*B65D 85/20* (2006.01)
*A45C 7/00* (2006.01)

(52) U.S. Cl.
USPC ..... 206/315.1; 190/107

(58) Field of Classification Search
USPC ..... 211/35, 38, 60.1, 75, 85.15, 85.3, 85.7, 211/113, 118, 149; 206/315.1, 315.9, 373; 190/107, 109–111, 901; 383/4, 22, 23, 383/38–40, 106, 107, 117; 4/417–420
See application file for complete search history.

(56) References Cited

U.S. PATENT DOCUMENTS

| | | | | | |
|---|---|---|---|---|---|
| 746,013 | A * | 12/1903 | Burton | 383/22 |
| 1,094,009 | A * | 4/1914 | Parkhurst | 206/373 |
| 1,526,122 | A * | 2/1925 | Dau | 206/479 |
| 1,728,212 | A * | 9/1929 | McCollum | 190/107 |
| 3,575,327 | A * | 4/1971 | Harrison | 294/149 |
| 3,900,060 | A * | 8/1975 | Shammas | 206/6.1 |
| 4,210,244 | A * | 7/1980 | Westrick | 206/373 |
| 4,901,464 | A * | 2/1990 | Banoun | 42/95 |
| 4,991,245 | A * | 2/1991 | Franco | 5/419 |
| 5,002,401 | A * | 3/1991 | Blackman | 383/38 |
| 5,327,669 | A * | 7/1994 | Lannan et al. | 43/26 |
| 5,337,907 | A * | 8/1994 | McKenzie et al. | 211/88.01 |
| 6,070,729 | A * | 6/2000 | Barnes | 206/581 |
| 6,092,702 | A * | 7/2000 | Cassidy, IV | 224/153 |
| 6,209,723 | B1 * | 4/2001 | Fields | 206/373 |
| 6,233,765 | B1 * | 5/2001 | Verhulst | 5/503.1 |
| 6,948,599 | B2 * | 9/2005 | Rodrigue et al. | 190/107 |
| 7,028,870 | B2 * | 4/2006 | Valdez-Campbell | 224/153 |
| 7,134,535 | B1 * | 11/2006 | Horvat | 190/20 |
| 7,278,539 | B2 * | 10/2007 | Souza | 206/315.1 |
| 7,328,780 | B2 * | 2/2008 | Hawthorne | 190/107 |
| 7,614,100 | B1 * | 11/2009 | Barrington et al. | 5/420 |
| 7,841,467 | B2 * | 11/2010 | Slayton | 206/315.1 |
| 7,891,733 | B1 * | 2/2011 | Clarke | 297/188.06 |
| 2002/0074199 | A1 * | 6/2002 | Albritton | 190/107 |
| 2004/0050638 | A1 * | 3/2004 | Rodrigue et al. | 190/107 |
| 2005/0082130 | A1 * | 4/2005 | McGrath | 190/26 |
| 2006/0171606 | A1 * | 8/2006 | Valentine | 383/4 |
| 2006/0260049 | A1 * | 11/2006 | Wenz | 5/503.1 |
| 2007/0017835 | A1 * | 1/2007 | Miller | 206/315.1 |
| 2007/0119883 | A1 * | 5/2007 | Albritton | 224/153 |
| 2009/0188819 | A1 * | 7/2009 | Carney et al. | 206/315.1 |

* cited by examiner

*Primary Examiner* — Joshua Rodden
(74) *Attorney, Agent, or Firm* — Ramon L. Pizarro; Edwin H. Crabtree

(57) ABSTRACT

A flexible storage device is particularly well suited for use in dugouts, for holding equipment used in sports, such as baseball and softball is disclosed. An example of the device includes central pocket between front and back surfaces to use for storage, or for use in decorating. The device is flexible to allow it to be rolled up for quick and simple transport, and includes an elastic device for retaining bats. Additionally an arrangement that allows weight balance of items being held, bats on the sides, helmet, mitt and sunglasses pocket in center, which obviates the need for rigid structure is also disclosed.

5 Claims, 2 Drawing Sheets

DUGOUT LOCKER

REFERENCE TO RELATED APPLICATIONS

This application claims the benefit of my provisional application having Ser. No. 61/397,913, filed Jun. 17, 2010.

BACKGROUND OF THE INVENTION (a) Field of the Invention

This application relates to a device that has been adapted for supporting items used for playing softball or baseball from a vertical surface, such as a chain-link fence. More particularly, but not by way of limitation, to a support device that can be rolled-up when not in use, and then extended and hung from a vertical surface, and which includes a pair of generally parallel panels that are used to retain items between them, and external pockets mounted on at least one of the panels.

(b) Discussion of Known Art

The popular games of baseball and softball often require that team players, and participants, carry a significant amount of equipment to the game. This equipment includes items such as a change of shoes, batting gloves, mitts, masks, hats, drinks, and jackets, to name a few. Often, softball or baseball teams include a roster of at least twelve players, each of whom will bring to the game all of the equipment he or she will anticipate needing during the game. All of this equipment is brought into the dugout area, where the players will have to organize their equipment in a manner that is easily and quickly accessible, so that the player can head to the field when needed, without delaying the game.

Dugout areas will typically include a vertical structure or surface, which is often made up in part or in whole of chain-link fencing. Players often use bags such as the bag described in U.S. Pat. No. 7,559,423 to Vosloo, incorporated herein by reference in its entirety. A significant problem associated with bags such as the Vosloo device is that they take up a significant amount of space, arguably more space than the equipment that they carry. This is a significant problem in dugout areas, which are very limited in space. Another approach is disclosed in U.S. Pat. No. 7,841,467 to Slayton, which is also incorporated herein by reference in its entirety. The Slayton device uses less space than the Vosloo device, but suffers from the limitations introduced by the use of rigid panels, which limit the degree in which the device may be compacted. Flexible shoe bags are known, and an example of such a bag is disclosed in U.S. Pat. No. 1,684,232, which is also incorporated herein by reference in its entirety.

Thus, a review of known art reveals that there remains a need for a compact, high-capacity device for holding personal equipment at a softball or baseball game.

SUMMARY

It has been discovered that the problems left unanswered by known art can be solved by providing a flexible, collapsible, equipment support device for supporting or storage of items from a vertical surface. The flexible storage device is particularly well suited for use in dugouts, for holding equipment used in sports, such as baseball and softball, and an example of the invention includes:

1. a central pocket between front and back surfaces to use for storage, or for use in decorating;
2. a configuration that easily folds or rolls up for quick and simple transport;
3. includes an elastic device for retaining bats, for simplicity and cost effectiveness; and
4. an arrangement that allows weight balance of items being held, bats on the sides, helmet, mitt and sunglasses pocket in center, which obviates the need for rigid structure.

Still further, the concepts disclosed herein may be used to create a flexible device that serves to hold bats, or helmet, or balls. It is contemplated that different versions with different mechanical attachments may be used, for instance pockets, hooks, or loops for supporting equipment, as well as pockets for drink bottles. It is also contemplated that the disclosed invention may be hung inside the baseball field during practice for easy access to equipment, whether batting or fielding.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
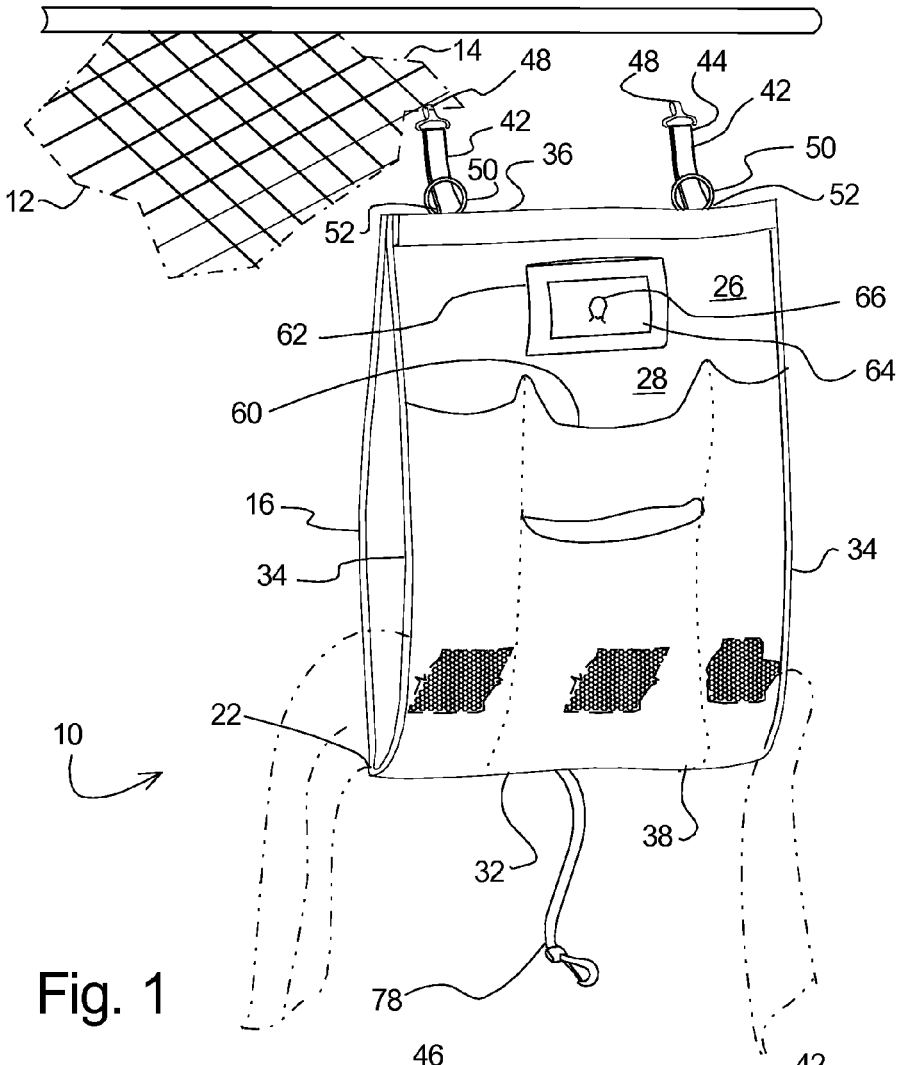
FIG. 1 is a perspective view of an embodiment of the invention shown while hanging from a vertical surface made of chain-link fence.

Turning now to FIG. 1 where a flexible, collapsible, equipment support device 10 made in accordance with the principles taught herein has been illustrated. The equipment support device 10 is particularly well-suited for supporting or storing items from a vertical surface 12, such as the chain link fence sections 14 typically found in dugout areas.

Figures 3, 4, 5:
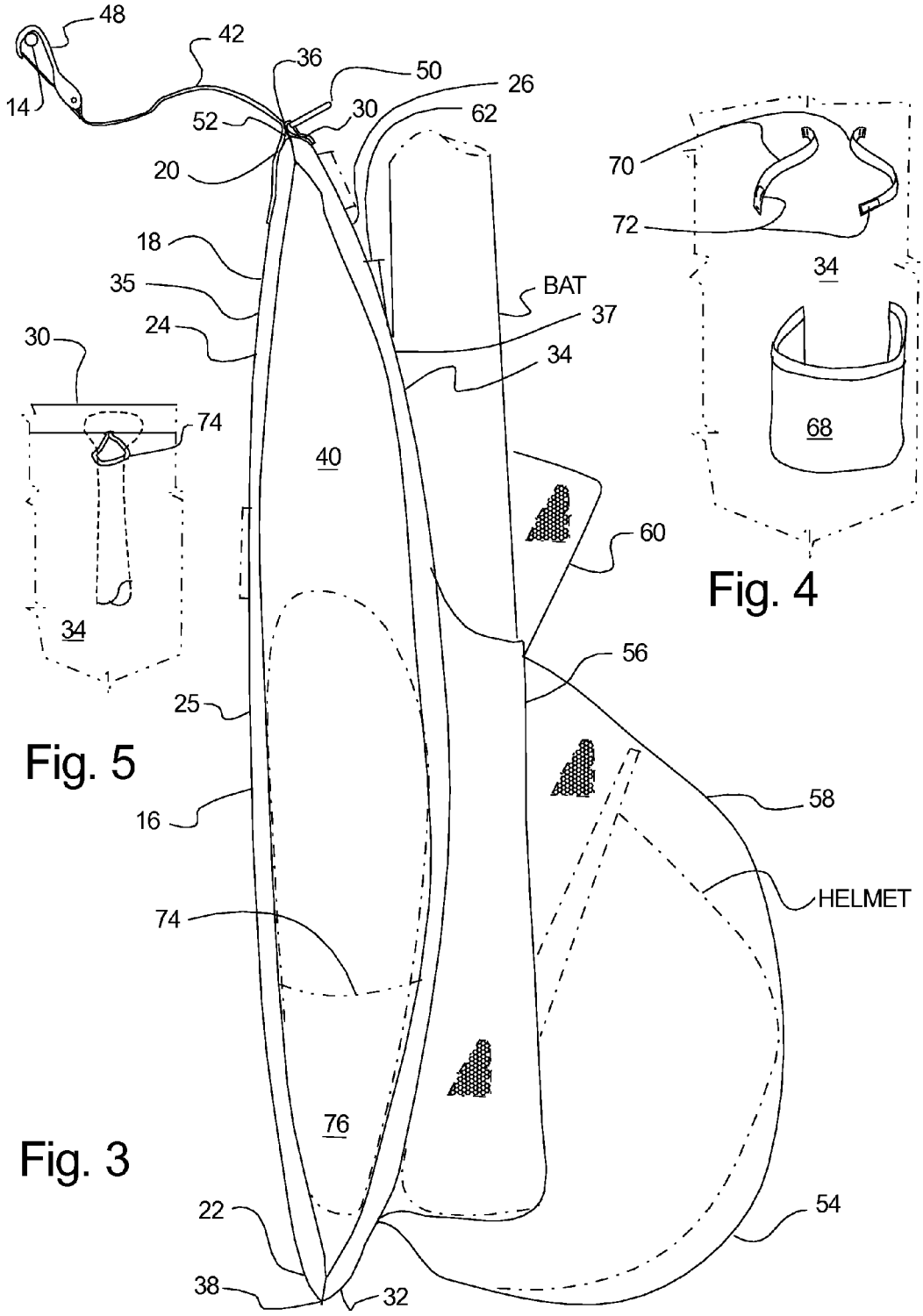
FIG. 3 is a side view illustrating the disclosed invention while in use.
FIG. 4 illustrates another example of a bat pocket.
FIG. 5 illustrates the use of an elastic loop to cooperate with the handle and the knob of a bat, to support the bat from the disclosed invention.

Referring to FIGS. 1 and 3 it will be understood that a preferred example of the invention will be made from a rectangular first flexible panel 16 that has a first panel façade 18. The first flexible panel 16 will also include a first panel upper edge 20, a first panel lower edge 22, and a pair of first panel side edges 24, which may incorporate or consist of a section of hook and loop type material 35. In the illustrated preferred example of the invention, the entire device is made of a flexible material, such as a heavy-duty textile, or a reinforced vinyl material, or similar flexible material.

Connected to the rectangular first flexible panel 16 will be a rectangular second flexible panel 26, which includes a second panel façade 28, a second panel upper edge 30, a second panel lower edge 32 and a pair of second panel side edges 34. The second panel side edges 34 may incorporate or consist of a section of hook and loop material 37 that cooperates with the hook and loop material 35 found along the side edge 25 of first flexible panel so that the collapsible equipment support device is retained in a rolled up position by the mating sections of hook and loop material found on the first panel side edges 24 and the second panel side edges 34. Additionally, the first panel upper edge 20 and second panel upper edge 30 will be attached to one another to create an upper junction 36. Additionally, the first panel lower edge 22 and second panel lower edge 32 will be attached to one another to create a lower junction 38, such that the two panels create a sleeve-like opening, to define a horizontal passage 40 between the first panel and the second panel. The horizontal passage 40 will allow the user to support large items, such as jackets, protective padding, blankets, towels, and the like, without the limitations of bags and similar fully enclosed devices that limit the support capabilities to items that can be fully enclosed within the bag.

Figure 2:
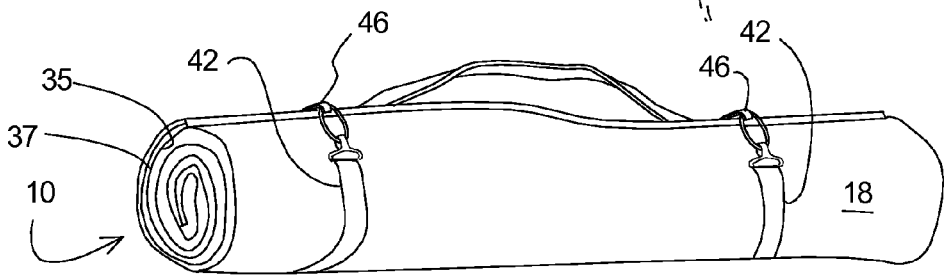
FIG. 2 illustrates the disclosed invention in a rolled up configuration.

Referring to FIGS. 1-3 it will be understood that a pair of flexible straps 42 will be attached to, or near, the upper junction 36. The flexible straps 42 will serve to support the device from the vertical surface 12 as well as to keep the equipment support device 10 in a rolled up configuration 12 when not in use. These figures also illustrate that each of the straps 42 will include a free end 44 that includes at least one fence hook 48 or other attachment mechanism, such as a tether or a j-hook.

FIGS. 1-3 also illustrate that a pair of retention loops 50 will preferably be attached to the upper junction 36 near the attachment 52 of the pair of straps 42 to the upper junction 36.

Additionally, at least one pocket 54 will be mounted from the second panel façade 28. This arrangement will allow the use the straps 42 to support the collapsible support device 10 from the vertical surface 12. In order to use a configuration that would include a single strap 42, it is contemplated that the single strap would be mounted at mid-span along the upper junction 36. This unrolled, vertical support allows storage of items in the horizontal passage 40 as well as storage of items in the pocket 54 on the façade 28 of the second panel 26. It is important to note that more than one pocket may be attached to the second panel 26. Thus, in the example illustrated in FIG. 1 a pair of elongated pockets 56 flank a helmet pocket 58 and a glove pocket 60. Additionally, an upper pocket 62 that includes a transparent window 64 for accepting an identification card 66, and which can support other items such as sunglasses has also been shown. It is contemplated that the pockets mounted on the façade 28 will be made of a mesh material, to enhance the flexibility and versatility of the disclosed invention. The mesh material will easily conform to the shape of an item being supported, and will be easily rolled up when the disclosed invention is not in use.

FIG. 1 illustrates a helmet strap 78 that may also be used to support a helmet or a glove.

Referring to FIG. 4, it will be understood that the bat pockets or compartments may be made from a relatively shallow sleeve 68, which cooperates with a pair of straps 70 with a connector such as sections of hook and loop material 72, or an elastic device or strap to hold the bat in an upright position when the invention is hung from a vertical surface. FIG. 5 illustrates the use of an elastic loop 74 to engage the handle and the knob of a bat while supporting a bat from the disclosed invention, instead of using a pocket for support as used in other examples of the invention.

Still further, it will be understood that a gusset made of at least one section of webbing 74 may be extend across, between the first panel side edges 24 and second panel side edges 34 at a location near the lower junction to create a bottom tray 76, which can be used to retain miscellaneous loose or odd shaped items.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A collapsible equipment support device for supporting or storage of items from a vertical surface, the collapsible support device comprising:

a rectangular first flexible panel having a first panel façade, a first panel upper edge, a first panel lower edge and a pair of first panel side edges;

a rectangular second flexible panel having a second panel façade, a second panel upper edge, a second panel lower edge and a pair of second panel side edges, the first panel upper edge and second panel upper edge being attached to one another to create an upper junction, and the first panel lower edge and second panel lower edge being attached to one another to create a lower junction and to define a horizontal passage between the first panel and the second panel;

a pair of flexible straps attached from the upper junction, each of the straps having a free end that includes at least one fence hook;

a pair of retention loops attached to the upper junction near the attachment of the pair of flexible straps to the upper junction;

at least one section of webbing extending between the first panel side edges and second panel side edges at a location near the lower junction to create a bottom tray; and at least one pocket mounted from the façade of the second panel, so that using the pair of flexible straps to support the collapsible support device from the vertical surface allows storage of items in the horizontal passage as well as storage of items in the pocket on the façade of the second panel, and so that the collapsible support device may be rolled up and secured while rolled up with the pair of flexible straps.

2. A collapsible equipment support device according to claim 1 wherein said at least one pocket comprises a mesh pocket.

3. A collapsible equipment support device according to claim 2 and further comprising at least one elongated pocket that is adapted for accepting the barrel of a bat.

4. A collapsible equipment support device according to claim 3 and further comprising an upper pocket having a transparent window for accepting an identification card.

5. A collapsible equipment support device according to claim 4 wherein said upper pocket also includes a sunglass compartment.

* * * * *